US011110719B2

(12) United States Patent
Sasaki et al.

(10) Patent No.: US 11,110,719 B2
(45) Date of Patent: Sep. 7, 2021

(54) LIQUID DISCHARGE HEAD

(71) Applicant: CANON KABUSHIKI KAISHA, Tokyo (JP)

(72) Inventors: Koji Sasaki, Nagareyama (JP); Masafumi Morisue, Tokyo (JP); Seiichiro Yaginuma, Kawasaki (JP); Shinji Kishikawa, Tokyo (JP); Masataka Nagai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/828,708

(22) Filed: Mar. 24, 2020

(65) Prior Publication Data

US 2020/0316956 A1 Oct. 8, 2020

(30) Foreign Application Priority Data

Apr. 2, 2019 (JP) ..... JP2019-070742

(51) Int. Cl.
*B41J 2/175* (2006.01)
*B41J 2/14* (2006.01)

(52) U.S. Cl.
CPC ..... *B41J 2/17596* (2013.01); *B41J 2/1404* (2013.01); *B41J 2002/14467* (2013.01); *B41J 2202/12* (2013.01)

(58) Field of Classification Search
CPC .... B41J 2/17596; B41J 2/175; B41J 2202/12; B41J 2002/14467; B41J 2/1404
USPC ..... 347/84, 85, 89
See application file for complete search history.

(56) References Cited

U.S. PATENT DOCUMENTS 8,622,530 B2 * 1/2014 Takada ..... B41J 2/17509 347/85
8,876,269 B2 * 11/2014 Hirano ..... B41J 2/1707 347/89
2019/0381793 A1 * 12/2019 Lang ..... B41J 2/14

FOREIGN PATENT DOCUMENTS

JP 5700879 B2 4/2015

* cited by examiner

*Primary Examiner* — An H Do
(74) *Attorney, Agent, or Firm* — Canon U.S.A., Inc. IP Division

(57) ABSTRACT

In a liquid discharge head, a first pump and a second pump are arranged inside a channel, the channel includes a pressure chamber including an energy generating element, and liquid inside the pressure chamber is circulatable between inside and outside of the pressure chamber by the first pump or the second pump. The first pump is arranged on one side relative to a midpoint of the channel in an extending direction of the channel, and the second pump is arranged on another side relative to the midpoint of the channel in the extending direction of the channel.

15 Claims, 6 Drawing Sheets

9a
9
8a
8b
2
7
5
6

9a
9
8a
8b
2a
2b
2
5
5a
5b
7
6
10a
10b

LIQUID DISCHARGE HEAD

BACKGROUND OF THE DISCLOSURE

Field of the Disclosure

The present disclosure relates to a liquid discharge head that discharges liquid.

Description of the Related Art

A liquid discharge apparatus typified by an inkjet printer includes a liquid discharge head that discharges liquid. The liquid discharge head includes an energy generating element that generates energy to discharge liquid, and a discharge port from which the liquid to which the energy has been applied by the energy generating element is discharged.

In the liquid discharge apparatus, liquid in the liquid discharge head may contain a foreign substance. In such a case, the foreign substance affects discharge of the liquid. For example, if an air bubble or an aggregated coloring material is mixed with liquid, liquid supply performance is degraded or a liquid discharge direction becomes unstable.

Japanese Patent No. 5700879 discusses a pump that is arranged separately from an energy generating element inside a channel of the liquid discharge head.

It is conceivable that the use of the pump as discussed in Japanese Patent No. 5700879 enables a foreign substance in liquid to flow, so that the foreign substance having flowed can be removed by suction from, for example, a discharge port. However, the inventors of the present disclosure have found that the method discussed in Japanese Patent No. 5700879 does not always enable a foreign substance in liquid to sufficiently flow. The pump discussed in Japanese Patent No. 5700879 can basically generate a flow in only one direction inside the channel. Consequently, a foreign substance caught in a curved portion of the channel, for example, does not tend to flow depending on a direction of a liquid flow.

SUMMARY OF THE DISCLOSURE

The present disclosure provides a liquid discharge head that enables a foreign substance inside a channel to flow well.

According to an aspect of the present disclosure, a liquid discharge head includes a substrate having a supply port, an energy generating element on the substrate, and a member that forms a channel through which liquid flows and a discharge port from which the liquid is discharged, wherein a first pump and a second pump are arranged inside the channel, the channel includes a pressure chamber including the energy generating element, and liquid inside the pressure chamber is circulatable between inside and outside of the pressure chamber by the first pump or the second pump, and wherein the first pump is arranged on one side relative to a midpoint of the channel in an extending direction of the channel, and the second pump is arranged on another side relative to the midpoint of the channel in the extending direction of the channel.

Further features and aspects of the present disclosure will become apparent from the following description of example embodiments with reference to the attached drawings.

DESCRIPTION OF THE EMBODIMENTS

Figure 1:
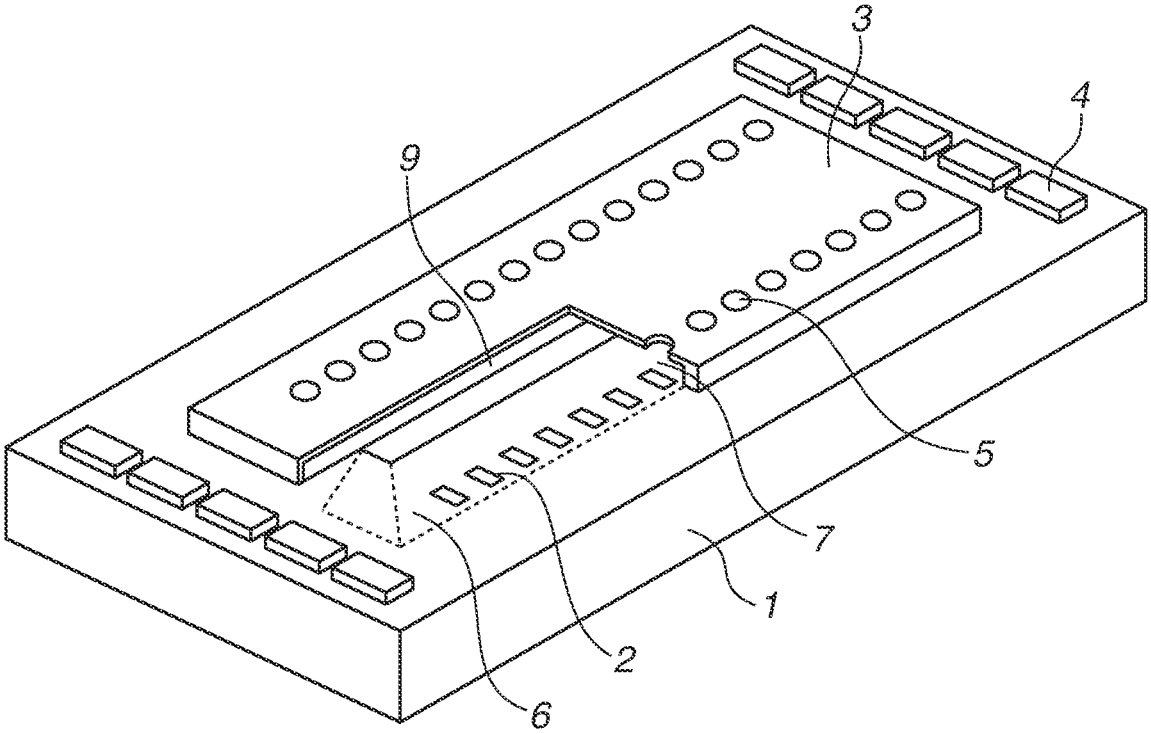
FIG. 1 is a diagram illustrating an example liquid discharge head.

Hereinafter, example embodiments, features and aspects of the disclosure are described with reference to the drawings. In each of the drawings and the descriptions, the same reference numerals are allocated to similar members, and redundant descriptions thereof may be omitted.

FIG. 1 is a diagram illustrating a liquid discharge head. The liquid discharge head can also be called a liquid discharge head substrate. Such a liquid discharge head includes a substrate 1, an energy generating element 2 arranged on the substrate 1, a member 3, and an electric contact 4 that is used to supply electric power to the energy generating element 2 from an external unit. The substrate 1 is formed of for example, a silicon single crystal substrate. The energy generating element 2 is formed of, for example, a heat resistor or a piezoelectric element. In the liquid discharge head illustrated in FIG. 1, the member 3 forms a discharge port 5, a pressure chamber 7, and a channel 9. The member 3 is made of resin (e.g., photosensitive resin) or metal (e.g., stainless), and is called a channel forming member or a discharge port forming member. The pressure chamber 7 is one portion of the channel 9, and the energy generating element 2 is arranged inside the pressure chamber 7. The discharge port 5 is opened in a position corresponding to the energy generating element 2.

On the substrate 1, a supply port 6 for liquid, which passes through the substrate 1, is formed. In FIG. 1, a plurality of pressure chambers 7 shares one common supply port 6. The liquid is supplied from the supply port 6 to each of the channels 9 and flows inside the channel 9. The liquid flows to the pressure chamber 7 inside the channel 9, and the energy generating element 2 of the pressure chamber 7 applies energy to the liquid. With such energy, the liquid is discharged from the discharge port 5 and then landed on a recording medium such as paper. Accordingly, recording of an image and such is performed.

Figures 2A, 2B, 2C:
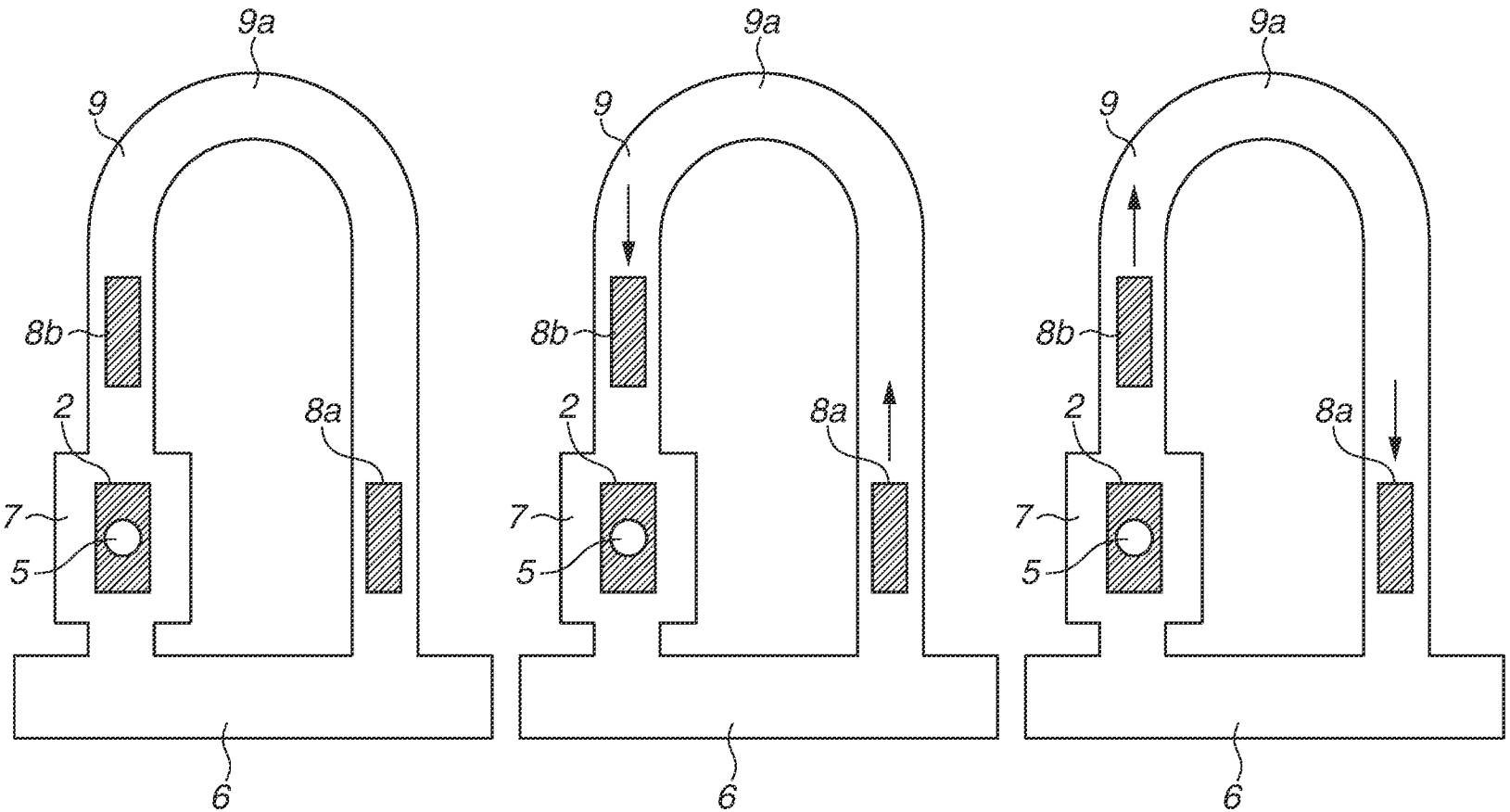
FIGS. 2A, 2B, and 2C are top views each illustrating an example structure of a channel in the liquid discharge head.

Each of FIGS. 2A through 2C is a diagram of the liquid discharge head illustrated in FIG. 1 as seen from a side opposite to a side on which a discharge port is opened (as seen from a side opposite to a discharge port surface, i.e., an upper side in FIG. 1). In each of the diagrams illustrated in FIGS. 2A through 2C, one portion of the channel 9 is enlarged. In each of the enlarged views of FIGS. 2A through 2C, one discharge port 5 in the liquid discharge head, the channel 9 corresponding to the discharge port 5, and the periphery thereof are illustrated, whereas a member forming a channel or a discharge port is omitted. As illustrated in FIG. 2A, the liquid discharge head of the present example embodiment includes a first pump 8*a* and a second pump 8*b* inside one channel 9. The term "one channel 9" used herein represents a channel in which liquid is supplied from the supply port 6 to flow on the substrate and returns to the supply port 6 again. As described above, the pressure chamber 7 is one portion of a structure of the channel 9. The energy generating element 2 is arranged inside the pressure chamber 7. The liquid inside the pressure chamber 7 can be circulated between the inside and the outside of the pressure chamber 7 by the first pump 8*a* or the second pump 8*b*.

In the present example embodiment, the first pump 8*a* or the second pump 8*b* is driven so that the liquid inside the pressure chamber 7 is circulated between the inside and the outside of the pressure chamber 7. However, the first pump 8*a* and the second pump 8*b* are also used to cause a foreign substance inside the channel 9 to flow. Liquid flows to be generated inside the channel 9 by the first pump 8*a* and the second pump 8*b* are described. The first pump 8*a* and the second pump 8*b* can be independently driven. In FIG. 2B, a black arrow indicates a liquid flow generated by the first pump 8*a* when the first pump 8*a* is driven. The liquid supplied from the supply port 6 flows based on the flow generated by the first pump 8*a* such that the liquid flows above the first pump 8*a* and the second pump 8*b* and passes through the pressure chamber 7 to return toward the supply port 6. Herein, a position where the liquid flows into the channel 9 from the supply port 6 differs from a position where the liquid flows out from the channel 9 to the supply port 6. In FIG. 2C, a black arrow indicates a liquid flow generated by the second pump 8*b*. In contrast to the case illustrated in FIG. 2B, the liquid supplied from the supply port 6 flows such that the liquid is first supplied to the pressure chamber 7 and then flows above the second pump 8*b* and the first pump 8*a* to return toward the supply port 6. That is, liquid flow directions in FIGS. 2B and 2C are opposite.

The liquid flow as described above is generated by arrangement of the first pump 8*a* and the second pump 8*b*. In the present example embodiment, the first pump 8*a* and the second pump 8*b* inside the channel 9 are positioned on opposite sides relative to a midpoint 9*a* in an extending direction of the channel 9. That is, the first pump 8*a* is arranged on one side relative to the midpoint 9*a* of the channel 9 in the extending direction of the channel 9, whereas the second pump 8*b* is arranged on the other side relative to the midpoint 9*a* of the channel 9 in the extending direction of the channel 9. In each of FIGS. 2A through 2C, the extending direction of the channel 9 is a curved direction. The term "the midpoint 9*a* of the channel 9" represents a position where a length of the channel 9 between two end portions to be connected to the supply port 6 of the channel 9 is halved in the extending direction of the channel 9. If the first pump 8*a* and the second pump 8*b* are arranged accordingly, in terms of the first pump 8*a*, for example, a length of the channel 9 on the side with the second pump 8*b* is longer than a length of the channel 9 on the side without the second pump 8*b*. In a case where the first pump 8*a* is driven in such a state, a main liquid flow is generated, as illustrated in FIG. 2B, in a direction (a forward direction) toward the side having a longer length of the channel 9. This is provided by fluid diode characteristics (i.e., a flow of fluid in one direction). On the other hand, in a case where the second pump 8*b* is driven in such a state, a liquid flow is generated in an opposite direction, as illustrated in FIG. 2C, by the similar principle.

In the present example embodiment, such a configuration enables a liquid flow direction to be reversed inside the channel 9. For example, a foreign substance may be mixed with liquid inside the channel 9 and then caught in a wall of channel 9. Even in such a case, the foreign substance can flow more easily by the reverse of the liquid flow direction.

Each of the first pump 8*a* and the second pump 8*b* can be a pump that enables liquid to flow inside the channel 9. For example, an oxide layer (e.g., a silicon oxide film) is formed on an upper surface of the substrate 1, and layers such as a metal layer made of aluminum (Al) or tantalum-silicon-nitride (TaSiN) and an insulation layer made of silicon nitride (SiN) are formed on an upper surface of the oxide layer, thereby providing a pump. However, the pump is not limited thereto. A pump such as a piezoelectric actuator pump, an electrostatic pump, and an electrohydrodynamics pump can be used. The first pump 8*a* and second pump 8*b* can be made of a same material or different materials. Moreover, the energy generating element 2 can be made of the same material as the first pump 8*a* and the second pump 8*b* or a different material. The energy generating element 2, the first pump 8*a*, and the second pump 8*b* are desirably made of the same material in a collective manner from a manufacturing standpoint. The term "same material" used herein does not represent an exact same composition. The energy generating element 2, the first pump 8*a*, and the second pump 8*b* are considered as being made of the same material as long as each of the energy generating element 2, the first pump 8*a*, and the second pump 8*b* is, for example, formed of TaSiN, even if there is an error such as a manufacturing error.

A drive method of each of the energy generating element 2, the first pump 8*a*, and the second pump 8*b* is not limited. For example, the energy generating element 2, the first pump 8*a*, and the second pump 8*b* can be selectively driven by an additional integrated circuit of the substrate 1. An example of the additional integrated circuit includes a drive transistor such as a field effect transistor (FET) associated with each energy generating element 2. The energy generating elements 2 include respective dedicated drive transistors capable of individually operating the respective energy generating elements 2. Each of the first pumps 8*a* and each of the second pumps 8*b* do not necessarily include a dedicated drive transistor since each of the first pumps 8*a* and each of the second pumps 8*b* do not need to be individually driven. In this case, one drive transistor simultaneously supplies electric power to all of the first pumps 8*a* in one group. Moreover, another drive transistor simultaneously supplies electric power to all of the second pumps 8*b* in one group.

Desirably, the first pump 8*a* and the second pump 8*b* are independently driven. An example of a timing at which the first pump 8*a* and the second pump 8*b* are driven to cause a foreign substance to flow includes a method for alternately driving the first pump 8*a* and the second pump 8*b*. This method can cause the foreign substance to flow more easily. Moreover, in a certain timing, the first pump 8*a* and the second pump 8*b* can be simultaneously driven. However, there is a possibility that the first pump 8*a* and the second pump 8*b* interfere with each other when the first pump 8*a* and the second pump 8*b* are simultaneously driven. Thus, if one of the first pump 8*a* and second pump 8*b* is being driven, the other is desirably not driven.

Figure 3A:
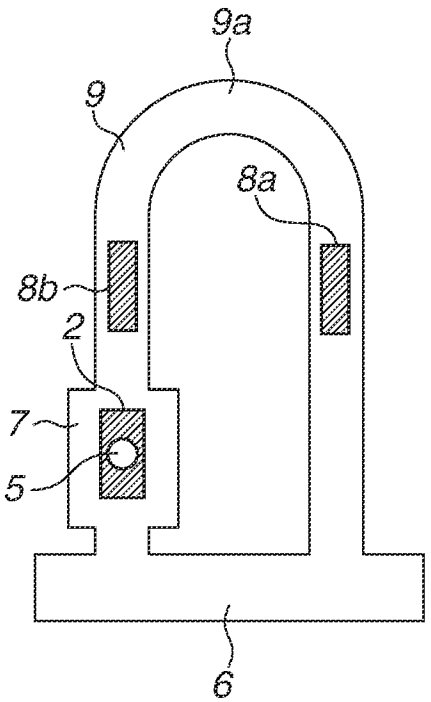
FIGS. 3A, 3B, 3C, and 3D are top views each illustrating an example structure of a channel in the liquid discharge head.

FIGS. 3A through 3D are examples in which arrangement or size of each pump is changed with respect to the channel configuration described in FIGS. 2A through 2C. In FIG. 3A, the first pump 8*a* and the second pump 8*b* inside the channel 9 are respectively positioned on one side and the other side relative to the midpoint 9*a* of the channel 9. This point is similar to each of FIGS. 2A through 2C. In each of FIGS. 2A through 2C, the first pump 8*a* and the second pump 8*b* inside the channel 9 are located at different distances from the midpoint 9*a*. By contrast, in FIG. 3A, the first pump 8*a* and the second pump 8*b* inside the channel 9 are located at equal distances from the midpoint 9*a*. With such an arrangement, circuits of the first pump 8*a* and the second pump 8*b* are designed more easily. The term "equal" used herein has the meaning including a manufacturing error.

Figure 3B:
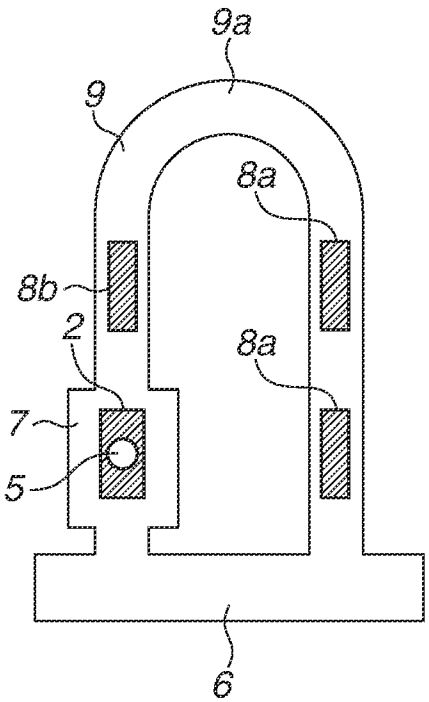

FIG. 3B illustrates a configuration in which a plurality of first pumps 8*a* is (two first pumps 8*a* are) arranged inside one channel 9. With such a configuration, even if one of the first pumps 8*a* cannot be used, a liquid flow can be generated by the other first pump 8*a*. However, the number of the first pumps 8*a* in one channel 9 is desirably three or less from a channel design standpoint. Similarly, a plurality of second pumps 8*b* can be arranged inside one channel 9. In such a case, the number of the second pumps 8*b* is desirably three or less. In a case where a plurality of first pumps 8*a* or second pumps 8*b* is arranged in one channel 9, the first pumps 8*a* or the second pumps 8*b* can be simultaneously driven or individually driven.

Figure 3C:
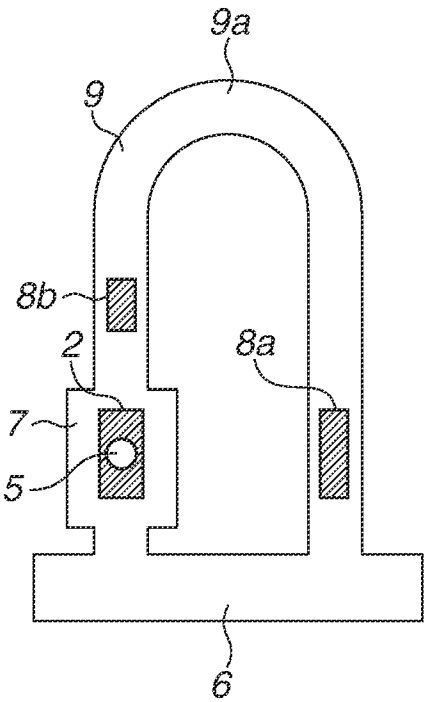

FIG. 3C illustrates a configuration in which the first pump 8*a* and the second pump 8*b* differ in size. In particular, the first pump 8*a* has a longer length along an extending direction of the channel 9 than the second pump 8*b*. Such a configuration enhances a liquid flow in a direction toward the second pump 8*b* from the first pump 8*a*, so that a foreign substance stayed near the pressure chamber 7 flows more easily. An increase in size of both of the first pump 8*a* and the second pump 8*b* can also cause a foreign substance stayed near the pressure chamber 7 to flow more easily. However, the second pump 8*b* is positioned relatively near the pressure chamber 7. Thus, without increasing a size of the second pump 8*b*, a foreign substance as described above can flow in a good manner.

Figure 3D:
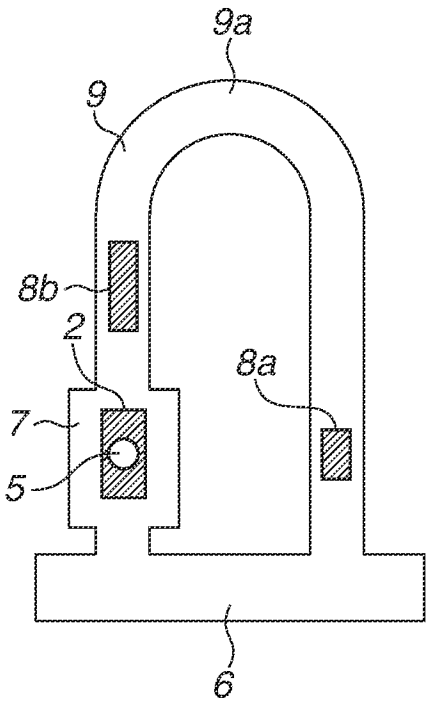

FIG. 3D illustrates an example of a configuration in which the first pump 8*a* and the second pump 8*b* differ in size, and the first pump 8*a* has a shorter length along an extending direction of the channel 9 than the second pump 8*b*. In the present example embodiment, such a configuration can be applied, for example, if there is a design restriction or a liquid flow by the second pump 8*b* is intended to be enhanced.

Figure 4A:
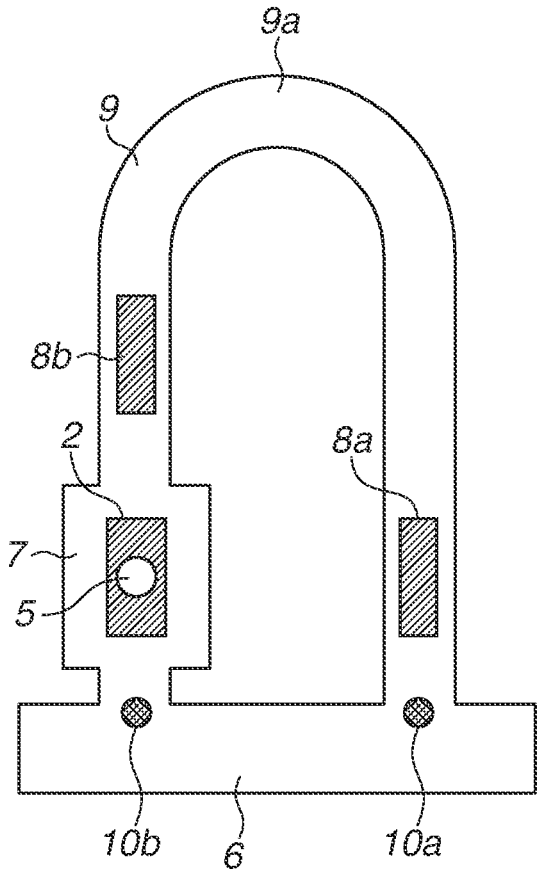
FIGS. 4A and 4B are top views each illustrating an example structure of a channel in the liquid discharge head.
Figure 4B:
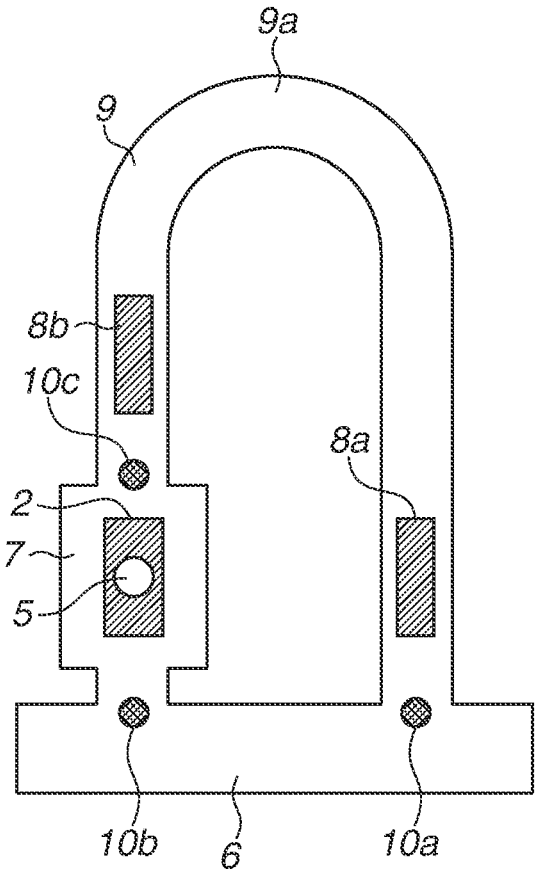

FIGS. 4A and 4B are diagrams illustrating configurations of the channel 9 corresponding to FIGS. 2A through 2C. FIGS. 4A and 4B differ from FIGS. 2A through 2C in having a filter inside the channel 9. In FIG. 4A, filters 10*a* and 10*b* are arranged in respective positions of two end portions connected to the supply port 6 of the channel 9. With the filters 10*a* and 10*b* in such positions, a foreign substance does not tend to enter the pressure chamber 7 from the supply port 6. Moreover, the use of the filter 10*a* or 10*b* causes a liquid flow by the first pump 8*a* or the second pump 8*b* to be generated more easily inside the channel 9. The configuration illustrated in FIG. 4B includes a filter 10*c* arranged between the second pump 8*b* and the energy generating element 2 in addition to the configuration illustrated in FIG. 4A. The filter 10*c* functions to further hinder a foreign substance to enter the pressure chamber 7. Herein, the filter is illustrated in a circular shape. However, for example, a filter having a polygonal column shape can be used.

Figures 5A, 5B, 5C, 5D:
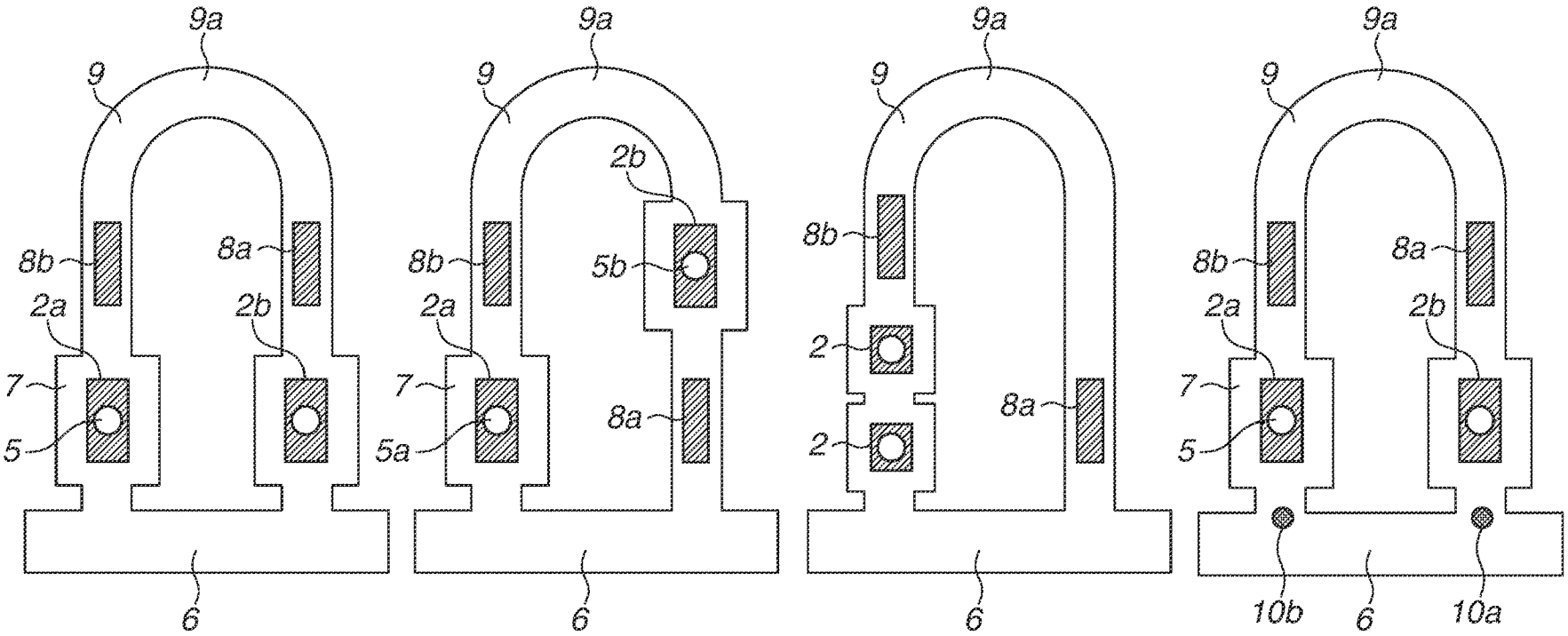
FIGS. 5A, 5B, 5C, and 5D are top views each illustrating an example structure of a channel in the liquid discharge head.

FIGS. 5A through 5D are diagrams each illustrating a configuration in which a plurality of energy generating elements is arranged inside one channel 9. In FIG. 5A, a set of a first energy generating element 2*a* and the second pump 8*b* is arranged on one side relative to the midpoint 9*a* of the channel 9, whereas a second energy generating element 2*b* and the first pump 8*a* is arranged on the other side. Such an arrangement is desirable since the discharge ports 5 can be arrayed at a high density.

In contrast to the arrangement illustrated in FIG. 5A, FIG. 5B illustrates a staggered arrangement of the energy generating elements and the pumps (the first pump 8*a* and the second pump 8*b*). With such an arrangement, the discharge ports 5 can be arrayed at a higher density. Particularly, in the configuration illustrated in FIG. 5B, an opening area of a discharge port (herein a discharge port 5*a*) near the supply port 6 is set to be relatively large, and an opening area of a discharge port (herein a discharge port 5*b*) far from the supply port 6 is set to be relatively small, so that a liquid supply balance can be improved. In FIG. 5B, the opening areas of the discharge ports are substantially equal.

FIG. 5C illustrates a configuration in which two energy generating elements 2, two discharge ports 5, and two pressure chambers 7 are arranged, with respect to the configuration illustrated in FIG. 2A. The two energy generating elements 2, the two discharge ports 5, and the two pressure chambers 7 are arranged on one side relative to the midpoint 9*a* of the channel 9. With such a configuration, the discharge ports 5 can be arrayed at a high density.

FIG. 5D is a diagram illustrating a configuration in which the filter 10*a* and the filter 10*b* are added to the configuration illustrated in FIG. 5A. With such a configuration, the discharge ports 5 can be arrayed at a high density, and a foreign substance can be prevented from entering the pressure chamber 7.

Figure 6A:
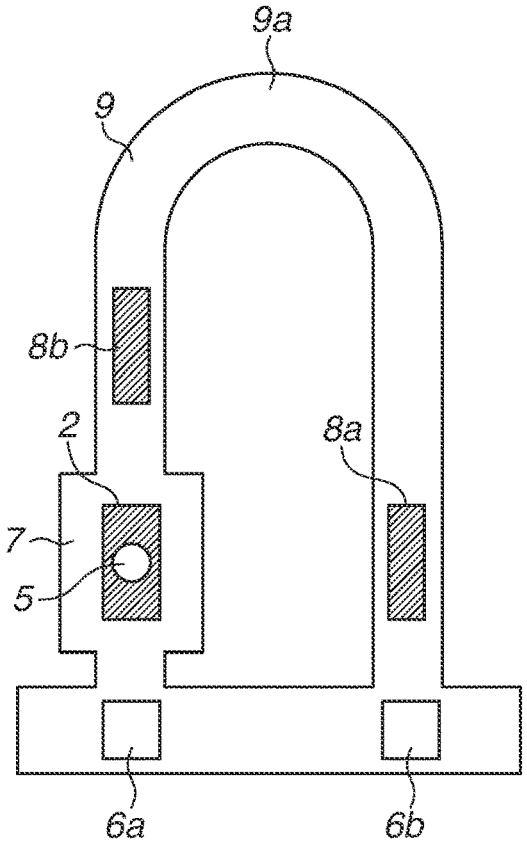
FIGS. 6A and 6B are top views each illustrating an example structure of a channel in the liquid discharge head.
Figure 6B:
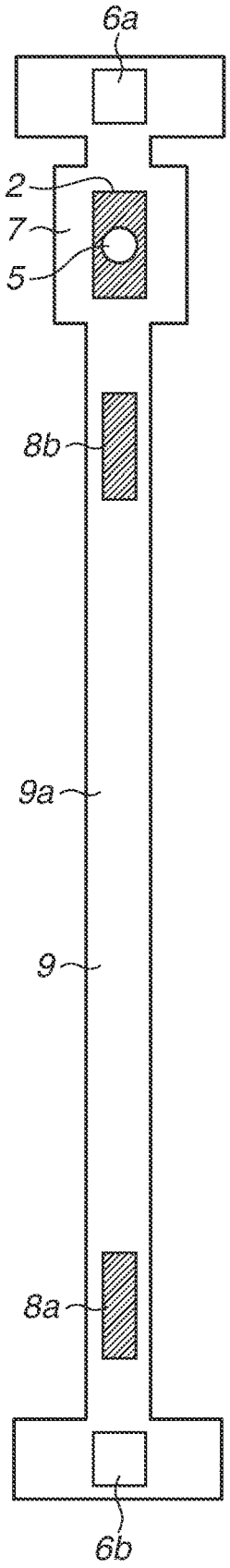

The description has been given using an example in which one common supply port 6 is arranged with respect to a plurality of pressure chambers 7. In the present example embodiment, a plurality of independent supply ports 6 can be arranged, and an individual supply port 6 can be arranged for each pressure chamber 7. FIG. 6A illustrates a configuration in which supply ports 6*a* and 6*b* are independently arranged. One channel 9 represents a channel in which liquid is supplied from the supply port 6*b* to flow on the substrate and returns to the supply port 6*a*. Such a configuration is desirable since the supply ports 6*a* and 6*b* can be arrayed at a high density. Even such a configuration enables a foreign substance inside the channel 9 to flow as similar to the above description. Moreover, a shape of the channel 9 is not limited to a curved shape. The channel 9 can have a linear shape as illustrated in FIG. 6*b*.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2019-070742, filed Apr. 2, 2019, which is hereby incorporated by reference herein in its entirety.

What is claimed is:

1. A liquid discharge head comprising:

a substrate having a supply port;

an energy generating element on the substrate; and a member that forms a channel through which liquid flows and a discharge port from which the liquid is discharged, wherein a first pump and a second pump are arranged inside the channel, the channel includes a pressure chamber including the energy generating element, and liquid inside the pressure chamber is circulatable between inside and outside of the pressure chamber by the first pump or the second pump, and wherein the first pump is arranged on one side relative to a midpoint of the channel in an extending direction of the channel, and the second pump is arranged on another side relative to the midpoint of the channel in the extending direction of the channel.

2. The liquid discharge head according to claim 1, wherein the first pump and the second pump are arranged in locations at different distances from the midpoint of the channel.

3. The liquid discharge head according to claim 1, wherein the first pump and the second pump are arranged in locations at equal distances from the midpoint of the channel.

4. The liquid discharge head according to claim 1, wherein a plurality of the first pumps or the second pumps is arranged.

5. The liquid discharge head according to claim 1, wherein the number of each of the first pumps and the second pumps is three or less.

6. The liquid discharge head according to claim 1, wherein the first pump differs from the second pump in a length along the extending direction of the channel.

7. The liquid discharge head according to claim 1, further comprising a filter in a position of an end portion connected to the supply port of the channel.

8. The liquid discharge head according to claim 1, wherein a set of the energy generating element and the first pump is arranged on one side relative to the midpoint of the channel, and a set of the energy generating element and the second pump is arranged on another side relative to the midpoint of the channel.

9. The liquid discharge head according to claim 8, wherein the first pump and the second pump are arranged in a staggered manner.

10. The liquid discharge head according to claim 1, wherein the number of energy generating elements arranged on the one side is two or more.

11. The liquid discharge head according to claim 1, wherein the supply port is arranged to correspond to a plurality of the pressure chambers.

12. The liquid discharge head according to claim 1, wherein a plurality of supply ports is independently arranged, and an individual supply port is arranged for each pressure chamber.

13. The liquid discharge head according to claim 1, wherein the first pump and the second pump are independently driven.

14. The liquid discharge head according to claim 13, wherein the first pump and the second pump are alternately driven.

15. The liquid discharge head according to claim 1, wherein a direction of a liquid flow generated inside the channel by driving of the first pump and a direction of a liquid flow generated inside the channel by driving of the second pump are opposite to each other.

* * * * *